US006927659B2

(12) United States Patent
Hans et al.

(10) Patent No.: US 6,927,659 B2
(45) Date of Patent: Aug. 9, 2005

(54) TWO-PART SOLENOID AND METHOD FOR THE PRODUCTION THEREOF

(75) Inventors: Waldemar Hans, Bamberg (DE); Mathias Linssen, Litzendorf (DE); Christof Vogel, Bischberg (DE); Helmut Hennemann, Schesslitz (DE)

(73) Assignee: Robert Bosch GmbH, Stuttgart (DE)

( * ) Notice: Subject to any disclaimer, the term of this patent is extended or adjusted under 35 U.S.C. 154(b) by 18 days.

(21) Appl. No.: 10/049,805

(22) PCT Filed: Jun. 8, 2001

(86) PCT No.: PCT/DE01/02147

§ 371 (c)(1),
(2), (4) Date: Jun. 19, 2002

(87) PCT Pub. No.: WO01/97236

PCT Pub. Date: Dec. 20, 2001

(65) Prior Publication Data

US 2002/0163410 A1 Nov. 7, 2002

(30) Foreign Application Priority Data

Jun. 14, 2000 (DE) ..... 100 29 279

(51) Int. Cl.[7] ..... H01F 27/29
(52) U.S. Cl. ..... 336/192; 336/198
(58) Field of Search ..... 335/192, 198, 335/220–229, 202; 123/520; 251/129.01–18; 439/810–814, 874–873; 336/192, 198, 107, 65, 83, 90–92

(56) References Cited

U.S. PATENT DOCUMENTS 4,041,430 A * 8/1977 Hrynewycz ..... 336/92
6,050,245 A * 4/2000 Cook et al. ..... 123/520

FOREIGN PATENT DOCUMENTS

| | | |
|---|---|---|
| DE | 85 15 795 | 9/1986 |
| DE | 295 14 315 | 12/1995 |
| DE | 10003055 A1 * | 1/2000 |
| EP | 0 596 356 | 5/1994 |
| EP | 0 811 995 | 12/1997 |
| FR | 2 655 473 | 6/1991 |

* cited by examiner

*Primary Examiner*—Licnoln Donovan
(74) *Attorney, Agent, or Firm*—Kenyon & Kenyon

(57) ABSTRACT

A solenoid including a substantially cylindrical hollow bobbin made of an insulating material is provided, which is mountable on a housing body and is provided with at least two relay connectors anchored in an end area of the bobbin and projecting axially therefrom, and the solenoid is also coupled to a contact element. The solenoid and the contact element are two separate components which are connectable to each other by a connecting part of the contact element attachable to the housing body, by a suitable securing method, e.g., by soldering or welding.

13 Claims, 3 Drawing Sheets

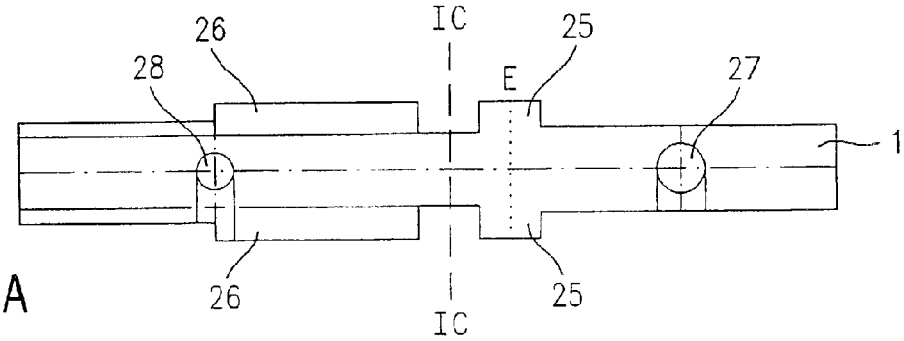
Fig. 1A
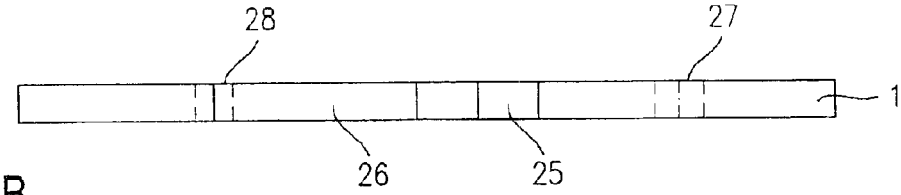
Fig. 1B
Fig. 1C
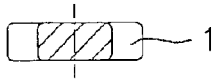
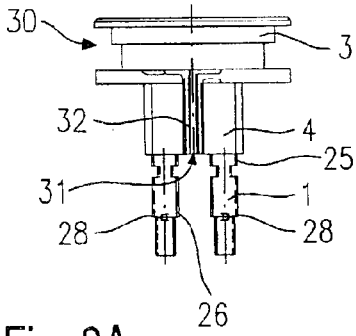
Fig. 2A
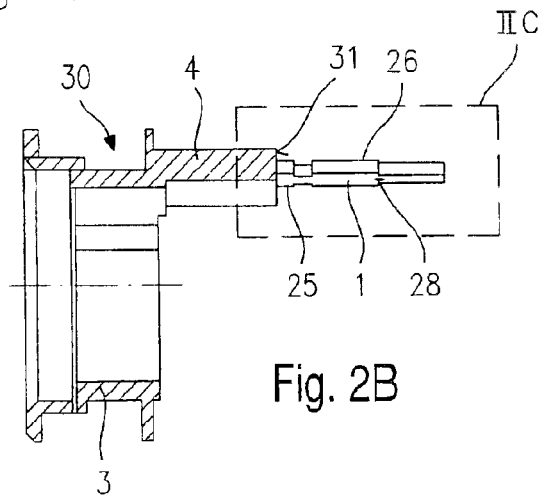
Fig. 2B
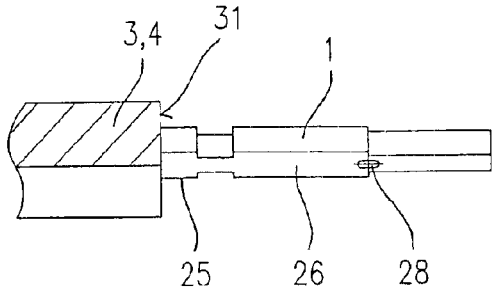
Fig. 2C

TWO-PART SOLENOID AND METHOD FOR THE PRODUCTION THEREOF

FIELD OF THE INVENTION

The present invention relates to a two-part solenoid and a method for the manufacture thereof.

BACKGROUND OF THE INVENTION

A solenoid described in German Patent 295 14 315 U1 includes a largely cylindrical hollow bobbin made of an insulating material that is provided with two relay connectors anchored in an end area of the bobbin and projecting axially therefrom, with which it is possible to wind the bobbin mechanically. The bottom of the bobbin forming the bottom of the winding space has variable adjacent winding levels in the axial direction which are offset against one another in the radial direction, with the transitions between the winding levels being designed as a bevel having an inclination of approximately 30 degrees. Except in the transition areas, the bottom of the bobbin is provided with grooves for the winding wire.

The disadvantage of the solenoid described in the above-mentioned German Patent 295 14 315 U1 lies, in particular, in the overall length of the solenoid, which is determined by the length of the relay connector. This makes the solenoid susceptible to damage, for example, when mechanically winding the coil wire. The relay connectors have a tendency to bend.

Another disadvantage is that different flat connectors for the electrical lines may require different manufacturing methods, which complicates the production process and makes it expensive.

SUMMARY OF THE INVENTION

The solenoid according to the present invention has the advantage over the related art that the short relay connectors enable the solenoid to be easily handled in subsequent processing steps, and, in addition, a contact element of any shape, for example a flat connector, may be attached to the solenoid by a simple snap-on connection and subsequently connected to the relay connectors.

An advantage of this invention is the easy manufacture of the relay connectors and contact elements, which may be manufactured, for example, by punching them out of a metal sheet.

The connecting part between the solenoid and the contact element is advantageously made of a flexible plastic which enables the contact element to be mounted on the bobbin or the valve housing.

The contact tabs of the contact element are still connected during manufacturing, which makes it easier to correctly position the contact tabs relative to each other. After being extrusion-coated with plastic, the contact tabs are separated by punching.

The angled extensions of the contact tabs give the contact element a shape that allows it to be easily connected to the relay connectors.

BRIEF DESCRIPTION OF THE DRAWINGS

FIG. 1A shows a schematic top view of a relay connector of a solenoid according to the present invention.

FIG. 1B shows a schematic side view of a relay connector of a solenoid according to the present invention.

FIG. 1C shows a sectional view of a cross-section taken along the line marked IC—IC in FIG. 1A.

FIG. 2A shows a schematic view of the bobbin of a solenoid according to the present invention.

FIG. 2B shows a longitudinal section of the bobbin of a solenoid according to the present invention.

FIG. 2C shows an enlarged view of area IIC shown in FIG. 2B.

DETAILED DESCRIPTION OF THE INVENTION

Figure 3A:
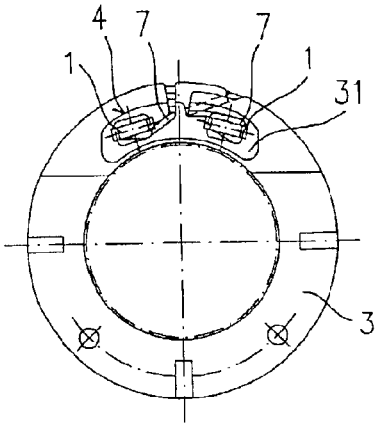
FIG. 3A shows a cross-section of a solenoid according to the present invention.
Figure 3B:
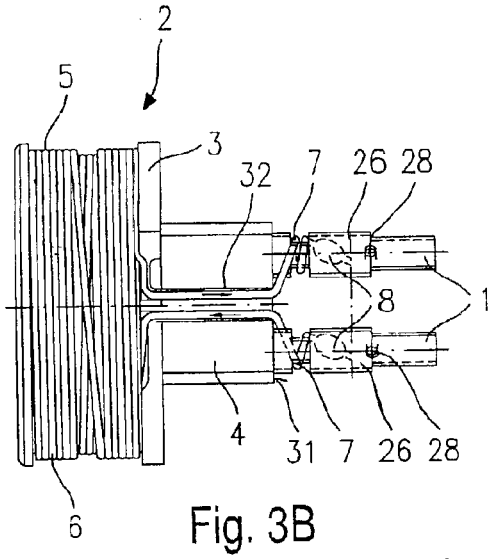
FIG. 3B shows a schematic side view of the solenoid shown in FIG. 3A.

Solenoid 2 according to the present invention, shown in FIG. 3B, is suitable, in particular, as a component for a fuel-injection valve like those used, for example, to inject fuel into the combustion chamber of a mixture-compressing, internal combustion engine with externally supplied ignition.

FIGS. 1A–1C show a schematic representation of a relay connector or terminal support 1 of a solenoid 2 according to the present invention in different views.

FIG. 1A shows a top view of relay connector 1, which is needed to suitably hold in place wire ends 7 of wire 6, which is shown in FIG. 3B, and which is wound to form solenoid 2, so that the ends may be connected to electrical lines leading to a control unit for the fuel injection valve.

Relay connector 1 has a generally tab-llke shape having side or lateral projections 25 and 26. Shorter projections 25 are used, in particular, to stabilize the position of relay connector 1 in a bobbin 3.

Projections 26 are used to widen the surface of relay connector 1 so that, after bobbin 3 has been wound, the ends of winding 5 can be attached to relay connector 1, for example by soldering.

Relay connector 1 also has holes 27 and 28, which, like projections 25 and 26, are used to fix relay connector 1 in place in bobbin 3 or to fasten wire ends 7. For example, wire ends 7 may be fed through hole 28 and then pinched. Hole 27 is filled with plastic when relay connector 1 is injected into bobbin 3, thereby securing relay connector 1 in place in bobbin 3.

FIG. 1B shows a corresponding side view of relay connector 1. Due to its simple shape, relay connector 1 may be easily produced, for example, by punching it out of a metal sheet.

FIG. 1C shows a cross-section along the line marked IC—IC in FIG. 1A. In an exemplary embodiment, relay connector 1 may have rounded edges, which further simplifies processing.

FIGS. 2A–2B show a schematic view and a schematic longitudinal section, respectively, of bobbin 3 of a solenoid 2 according to the present invention, and FIG. 2C shows an enlarged view of the area marked IIC in FIG. 2B.

FIG. 2A shows a schematic side view of unwound bobbin 3 having relay connectors 1 already attached to bobbin 3. Because of their simple shape, relay connectors 1 are easily connectable to bobbin 3. Bobbin 3 is principally made of plastic by injection molding. Relay connector 1 is injected into bobbin 3 up to lateral projections 25.

Bobbin 3 has a largely cylindrical hollow design with a circumferential recess 30 for holding winding 5.

An extension 4 of bobbin 3, which forms an end area and extends the cylindrical hollow cross-section of bobbin 3 in an angular range of approximately 40°, is molded onto bobbin 3. Relay connectors 1 are injected in one end area 31 of extension 4.

FIG. 2B shows a longitudinal section of bobbin 3 of solenoid 2 according to the present invention, illustrated in a schematic sectional representation. Relay connectors 1 are attached in projecting end area 31 of extension 4 of bobbin 3.

FIG. 2C shows an enlarged view of section IIC of FIG. 2B for further clarification. Relay connectors 1 are inserted into extension 4 of bobbin 3 up to the point marked E in FIG. 1A.

FIG. 3A shows a view of the relay connector end of a solenoid 2 according to the present invention. Of a winding 5 of solenoid 2, only wire ends 7, which are wound around relay connector 1, are visible.

FIG. 3B shows a side view of a solenoid 2 according to the present invention, around which winding 5 of a wire 6 is wound on bobbin 3. Wire ends 7 are routed from winding 5 of solenoid 2 via extension 4 of bobbin 3 to relay connectors 1. Wire ends 7 are routed to relay connectors 1 in an indentation 32 provided in extension 4 of bobbin 3, and they are wound around relay connectors 1 at least once in the area between projections 25 and 26 and may have flattened segments 8 for better attachment to relay connectors 1. Possible attachment methods include welding or soldering or even fixing wire ends 7 in hole 27.

Figure 4A:
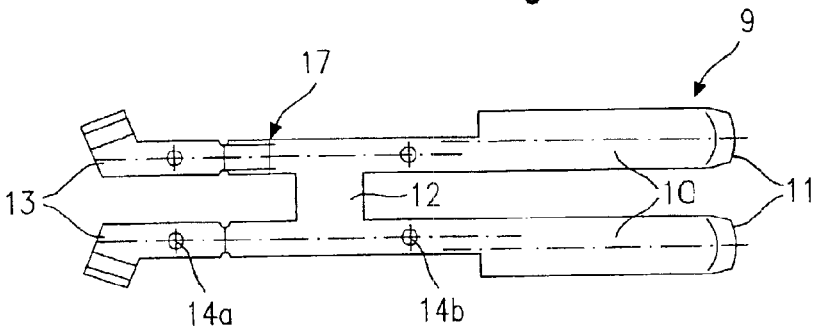
FIG. 4A shows a schematic view of the contact element of the solenoid according to the present invention in first of three consecutive stages of processing.
Figure 4B:
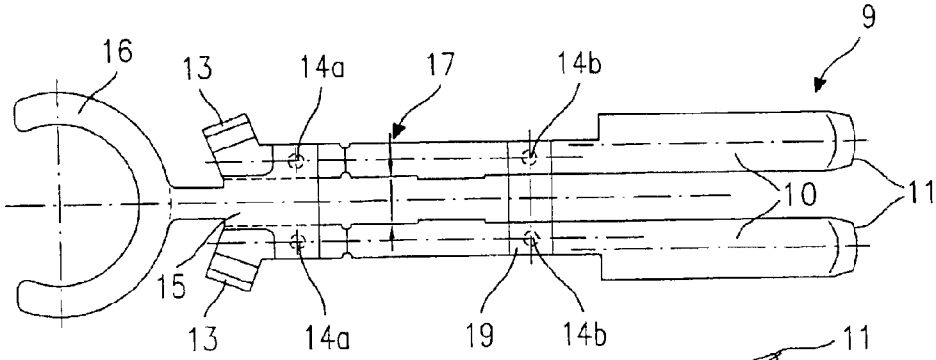
FIG. 4B shows a schematic view of the contact element of the solenoid according to the present invention in second of three consecutive stages of processing.
Figure 4C:
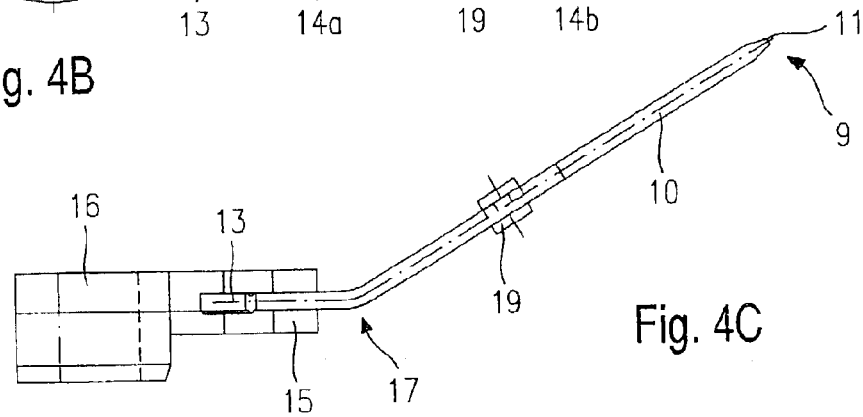
FIG. 4C shows a schematic view of the contact element of the solenoid according to the present invention in third of three consecutive stages of processing.

FIGS. 4A–4C show schematic representations of three consecutive processing steps in the manufacture of a contact element 9 according to the present invention.

FIG. 4A shows a schematic view of one exemplary embodiment of contact element 9, which, like relay connectors 1, is easily punchable from a metal sheet. Contact element 9 has two contact tabs 10 which have rounded front edges 11. Both contact tabs 10 are punched out in a single piece, connected by a web 12 which is removed later on. Two extensions 13 projecting outward at a desired angle are provided at the end of contact element 9 opposite rounded edges 11. Extensions 13 are used for connection to relay connectors 1 in a later processing step. Multiple holes 14*a*, 14*b* are provided in contact tabs 10 of contact element 9, with the present exemplary embodiment having two holes per contact tab 10.

In the next processing step, whereby contact element 9 is extrusion-coated, the plastic enters holes 14*a*, 14*b*, securely anchoring contact tabs 10 of contact element 9 in the plastic.

FIG. 4B shows a schematic view of contact element 9 after contact tabs 10 have been extrusion-coated with plastic. A first plastic web 15 is formed in the area of holes 14*a*. The plastic enters holes 14*a* and holds contact tabs 10 a certain distance apart, determined by the width of web 12. A connecting part 16 according to the present invention is injection-molded onto plastic web 15. For stability, a second plastic web 19 is provided in the area of holes 14*b* and used to stabilize the position of contact tabs 10 relative to one another.

To electrically isolate contact tabs 10, metallic web 12 is removed by punching.

First plastic web 15 continues into connecting part 16, which was injection-molded onto contact element 9, using a suitable apparatus which is not illustrated in any further detail here. Connecting part 16 is in the shape of a hollow cylinder that is open at one end. Slightly more than half of the cylinder wall is designed as a complete hollow cylinder. Extensions 13, which will connect contact tabs 10 to relay connectors 1 later on, project laterally from plastic web 15.

FIG. 4C shows a side view of the exemplary embodiment of contact element 9 illustrated in FIG. 4B after a further processing step. In this processing step, contact element 9 is bent at an approximately 30-degree angle toward the horizontal at a bending point 17 in the vicinity of plastic web 15.

FIGS. 5A–5E show a schematic representation of the method steps for connecting solenoid 2 according to the present invention to contact element 9.

Figure 5A:
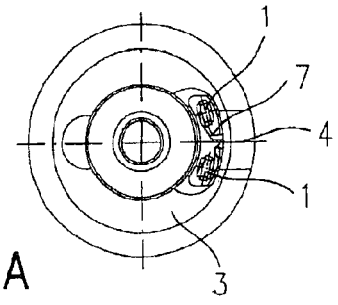
FIG. 5A shows a schematic representation of the first method step according to the present invention for connecting the solenoid to the contact element.

FIG. 5A shows a view similar to that in FIG. 3A of the relay connector end of bobbin 3. Relay connectors 1 and wire ends 7 are visible in end area 4 of bobbin 3.

Figure 5B:
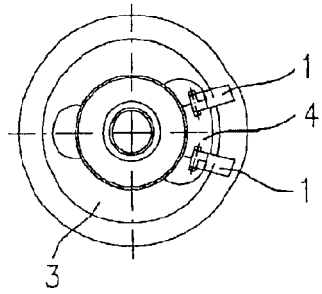
FIG. 5B shows a schematic representation of the second method step according to the present invention for connecting the solenoid to the contact element.

FIG. 5B shows the same representation of bobbin 3 after relay connectors 1 have been bent. Relay connectors 1 are preferably bent outward at a 90-degree angle from their previous position.

Figure 5C:
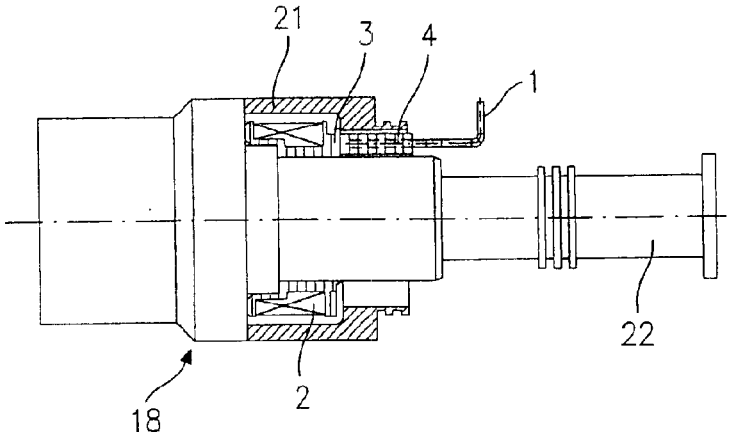
FIG. 5C shows a schematic representation of the third method step according to the present invention for connecting the solenoid to the contact element.

FIG. 5C shows a side view of solenoid 2 that is already mounted on a housing body 18. Housing body 18 has an external housing 21, which encapsulates solenoid 2, and an inner housing part 22 that grips solenoid 2 and has an outer diameter equal to the inner diameter of connecting part 16. Due to the special shape of connecting part 16 according to the present invention, it may be mounted on inner housing part 22 in a stable snap-on connection. Connecting part 16 surrounds inner housing part 22 in an area which forms an angle greater than 180 degrees, preventing connecting part 16 from sliding off inner housing part 22 in the radial direction.

Figure 5D:
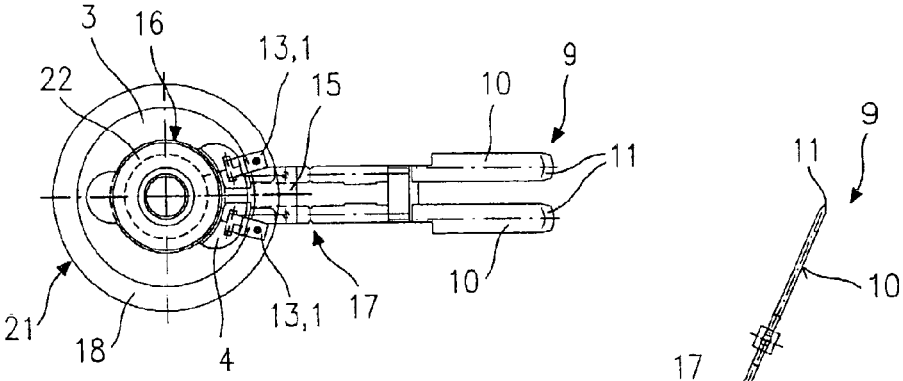
FIG. 5D shows a schematic representation of the fourth method step according to the present invention for connecting the solenoid to the contact element.

FIG. 5D shows the same view as FIGS. 5A and 5B, illustrating bobbin 3, which is mounted on inner housing part 22, with connecting element 9 positioned over connecting part 16. Extensions 13 of contact tabs 10 of contact element 9 come to rest on bent relay connectors 1 of bobbin 3. First plastic web of contact tabs 10 of contact element 9 has an external shape that prevents connecting part 16 from sliding on internal housing part 22.

Figure 5E:
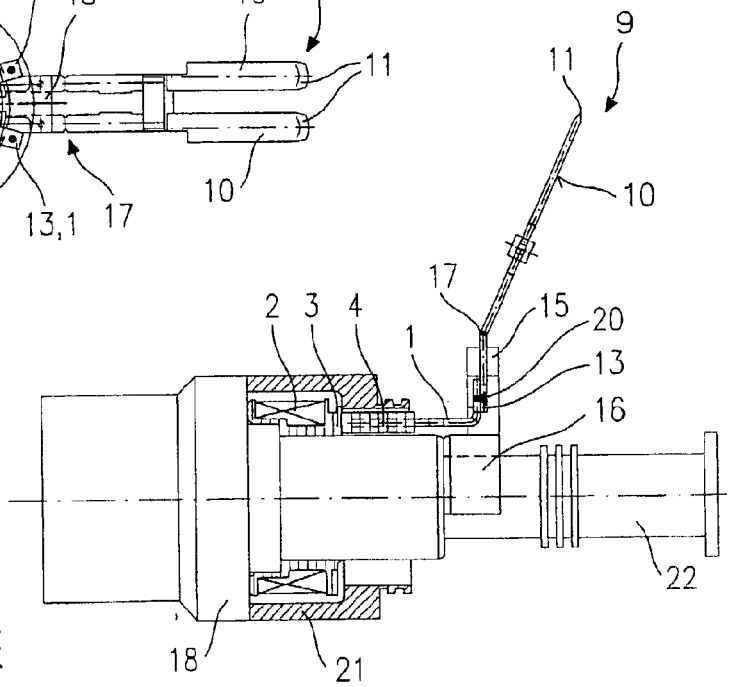
FIG. 5E shows a schematic representation of the fifth method step according to the present invention for connecting the solenoid to the contact element.

In the final method step, as shown in FIG. 5E, contact element 9 is connected to relay connectors 1 by a weld 20 or by soldering it onto extensions 13. The welding or soldering step arrests contact element 9 firmly in its final position so that it cannot move in either axial or radial direction. This also establishes a secure electrical contact between contact element 9 and relay connectors 1.

The present invention is not limited to the illustrated exemplary embodiment, but is also suitable for a contact element 9 having a wide variety of other shapes. According to the method of the present invention, coils having multiple windings insulated against one another may be provided with a contact element of any design.

What is claimed is:

1. A connectable solenoid for use with a housing body, comprising:

a solenoid having a substantially cylindrical hollow bobbin made of an insulating material slidable onto and adapted to be coupled to the housing body and provided with at least two relay connectors anchored in an end area of the bobbin and projecting axially therefrom; and a contact element having at least two contact tabs and including a connecting part attached to the housing body;

wherein the solenoid and the contact element are two separate components; and wherein the solenoid, via the at least two relay connectors, and the contact element, via the at least two contact tabs, are connected to each other by the connecting part of the contact element.

2. The connectable solenoid according to claim 1, wherein the contact element has at least two extensions that are connected to the relay connectors of the solenoid.

3. The connectable solenoid according to claim 2, wherein the contact element is attached to the relay connectors of the solenoid by one of soldering and welding.

4. The connectable solenoid according to claim 3, wherein the at least two contact tabs are connected to each other by a web.

5. The connectable solenoid according to claim 4, wherein the contact tabs have holes.

6. A connectable solenoid for use with a housing body, comprising:

a solenoid having a substantially cylindrical hollow bobbin made of an insulating material adapted to be coupled to the housing body and provided with at least two relay connectors anchored in an end area of the bobbin and projecting axially therefrom; and a contact element;

wherein the solenoid and the contact element are two separate components which are connected to each other by a connecting part of the contact element attached to the housing body;

wherein the contact element has at least two extensions that are connected to the relay connectors of the solenoid;

wherein the contact element is attached to the relay connectors of the solenoid by one of soldering and welding;

wherein the contact element has at least two contact tabs are connected to each other by a web;

wherein the contact tabs have holes; and wherein the contact element is connected to the connecting part by a first plastic web, the first plastic web extending between the contact tabs, and each of the holes located in the contact tabs being embedded in the first plastic web.

7. The connectable solenoid according to claim 6, wherein two further holes are connected to each other by a second plastic web which extends between the contact tabs.

8. A connectable solenoid for use with a housing body, comprising:

a solenoid having a substantially cylindrical hollow bobbin made of an insulating material slidable onto and adapted to be coupled to the housing body and provided with at least two relay connectors anchored in an end area of the bobbin and projecting axially therefrom; and a contact element having at least two contact tabs and including a connecting part attached to the housing body;

wherein the solenoid and the contact element are two separate components;

wherein the solenoid, via the at least two relay connectors, and the contact element, via the at least two contact tabs, are connected to each other by the connecting part of the contact element; and wherein the connecting part partially surrounds the housing body.

9. The connectable solenoid according to claim 1, wherein the housing body is cylindrical in shape.

10. A connectable solenoid for use with a housing body, comprising:

a solenoid having a substantially cylindrical hollow bobbin made of an insulating material slidable onto and adapted to be coupled to the housing body and provided with at least two relay connectors anchored in an end area of the bobbin and projecting axially therefrom; and a contact element having at least two contact tabs and including a connecting part attached to the housing body;

wherein the solenoid and the contact element are two separate components:

wherein the solenoid, via the at least two relay connectors, and the contact element, via the at least two contact tabs, are connected to each other by the connecting part of the contact element; and wherein the connecting part surrounds the housing body in an angular range that is greater than 180°.

11. The connectable solenoid according to claims 1, wherein the connecting part is made of an elastic plastic.

12. The connectable solenoid according to claim 6, wherein the connecting part is injection-molded onto the first plastic web.

13. The connectable solenoid according to claim 12, wherein a portion of each of the at least two contact tabs is bent at an angle.

* * * * *